US009756954B2

(12) United States Patent
Andrienko et al.

(10) Patent No.: US 9,756,954 B2
(45) **Date of Patent: *Sep. 12, 2017**

(54) SIDERAIL ASSEMBLY FOR PATIENT SUPPORT APPARTATUS

(71) Applicant: Hill-Rom Services, Inc., Batesville, IN (US)

(72) Inventors: Kirill Andrienko, Harrison, OH (US); Richard H. Heimbrock, Cincinnati, OH (US); Robert M. Zerhusen, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 315 days.

This patent is subject to a terminal disclaimer.

(21) Appl. No.: 14/298,217

(22) Filed: Jun. 6, 2014

(65) Prior Publication Data

US 2014/0283300 A1 Sep. 25, 2014

Related U.S. Application Data

(63) Continuation of application No. 12/943,482, filed on Nov. 10, 2010, now Pat. No. 8,745,786.

(51) Int. Cl.
*A47C 21/08* (2006.01)
*A61G 7/05* (2006.01)

(52) U.S. Cl.
CPC ..... *A47C 21/08* (2013.01); *A61G 7/051* (2016.11); *A61G 7/0507* (2013.01); *A61G 7/0514* (2016.11); *A61G 7/0524* (2016.11)

(58) Field of Classification Search
CPC ..... A47C 21/08; A61G 7/0507; A61G 2007/051; A61G 2007/0514; A61G 2007/0524; A61G 2007/0507; A61G 2007/0512; A61G 2007/0513; A61G 2007/0516
See application file for complete search history.

(56) References Cited

U.S. PATENT DOCUMENTS

| | | | |
|---|---|---|---|
| 421,656 | A | 2/1890 | Blanken |
| 1,279,120 | A | 9/1918 | Kellogg |
| 1,778,698 | A | 10/1930 | Walter |

(Continued)

FOREIGN PATENT DOCUMENTS

| | | | |
|---|---|---|---|
| DE | 102006011852 | B3 | 6/2007 |
| EP | 1816994 | B1 | 5/2011 |

(Continued)

OTHER PUBLICATIONS

English Abstract for DE 102006011852 (B3) 1 page, Jun. 6, 2007.

*Primary Examiner* — Eric Kurilla
(74) *Attorney, Agent, or Firm* — Barnes & Thornburg, LLP

(57) ABSTRACT

A siderail assembly includes a guide, a support frame coupled to the frame and movable between first and second positions, and a barrier coupled to the support frame and movable therewith. The siderail assembly further includes a handle coupled to the barrier to move between a first position and a second position relative to the barrier. The siderail assembly may include electronic controls to change the position or limit movement of various portions of a patient support apparatus on which the siderail assembly may be coupled.

17 Claims, 8 Drawing Sheets

(56) References Cited

U.S. PATENT DOCUMENTS 1,862,237 A * 6/1932 Pepler ..... A47B 23/02 108/140
2,585,660 A 2/1952 Kjos et al.
2,722,017 A 11/1955 Burst et al.
2,817,854 A 12/1957 Pratt
2,817,855 A 12/1957 Pratt
3,021,534 A 2/1962 Hausted
3,055,020 A 9/1962 Mann
3,100,129 A 8/1963 Adolphson
3,179,957 A 4/1965 Norton
3,220,024 A 11/1965 Nelson
3,249,387 A 5/1966 Pivacek
3,286,283 A 11/1966 Bertoldo
3,312,986 A 4/1967 Fahrni
3,318,596 A 5/1967 Herzog
3,344,445 A 10/1967 Crawford
3,351,962 A 11/1967 Dodrill
3,486,176 A 12/1969 Murcott
3,585,659 A 6/1971 Burst et al.
3,747,133 A 7/1973 Hutt
3,865,434 A 2/1975 Sully
3,932,903 A 1/1976 Adams et al.
3,971,083 A 7/1976 Peterson
4,002,330 A 1/1977 Johansson
4,105,242 A 8/1978 Terbeek
4,119,342 A 10/1978 Jones
4,120,530 A 10/1978 Imbro
4,221,370 A 9/1980 Redwine
4,277,100 A 7/1981 Beougher et al.
4,417,361 A 11/1983 Smith
4,426,071 A 1/1984 Klevstad
4,439,880 A 4/1984 Koncelik et al.
4,541,622 A 9/1985 Tabuchi et al.
4,612,679 A 9/1986 Mitchell
4,626,016 A 12/1986 Bergsten
4,632,450 A 12/1986 Holdt
4,680,790 A 7/1987 Packard et al.
4,691,962 A 9/1987 Holdt
4,703,975 A 11/1987 Roberts et al.
4,715,592 A 12/1987 Lewis
4,747,171 A 5/1988 Einsele et al.
4,795,214 A 1/1989 Holdt
4,839,933 A 6/1989 Plewright et al.
4,932,090 A 6/1990 Johansson
4,959,878 A 10/1990 Essek
4,993,089 A 2/1991 Solomon et al.
5,038,430 A 8/1991 Bly
5,060,327 A 10/1991 Celestina et al.
5,069,465 A 12/1991 Stryker et al.
5,083,430 A 1/1992 Hirata et al.
5,084,925 A 2/1992 Cook
5,195,200 A 3/1993 Leoutsakos
5,216,768 A 6/1993 Bodine et al.
5,231,721 A 8/1993 Fish
5,255,403 A 10/1993 Ortiz
5,333,887 A 8/1994 Luther
5,335,385 A 8/1994 Brown et al.
5,337,430 A 8/1994 Schlein
5,347,682 A 9/1994 Edgerton, Jr.
5,381,571 A 1/1995 Gabhart
5,384,927 A 1/1995 Mardero et al.
5,388,294 A 2/1995 Reeder
5,394,581 A 3/1995 Leoutsakos
5,418,988 A 5/1995 Iura et al.
5,433,235 A 7/1995 Miric et al.
5,463,784 A 11/1995 Alpern
5,471,689 A 12/1995 Shaw et al.
5,485,699 A 1/1996 Gabhart
5,542,136 A 8/1996 Tappel
5,542,138 A 8/1996 Williams et al.
5,586,352 A 12/1996 O'Brien et al.
5,659,910 A 8/1997 Weiss
5,678,267 A 10/1997 Kinder
5,680,661 A 10/1997 Foster et al.
5,689,839 A 11/1997 Laganiere et al.
5,715,548 A 2/1998 Weismiller et al.
5,781,945 A 7/1998 Scherer et al.
5,787,530 A 8/1998 Brix
5,802,636 A 9/1998 Corbin et al.
5,806,111 A 9/1998 Heimbrock et al.
5,832,549 A 11/1998 Le Pallec et al.
5,836,026 A 11/1998 Reed
5,842,237 A 12/1998 Hargest et al.
5,864,900 A * 2/1999 Landau ..... A61G 7/052 5/425
5,878,452 A 3/1999 Brooke et al.
6,009,570 A 1/2000 Hargest et al.
6,021,533 A 2/2000 Ellis et al.
6,058,531 A 5/2000 Carroll
6,076,209 A 6/2000 Paul
6,089,593 A 7/2000 Hanson et al.
6,101,678 A 8/2000 Malloy et al.
6,154,899 A 12/2000 Brooke et al.
6,163,903 A 12/2000 Weismiller et al.
6,182,310 B1 2/2001 Weismiller et al.
6,185,767 B1 2/2001 Brooke et al.
6,185,769 B1 2/2001 Larisey, Jr. et al.
6,212,714 B1 4/2001 Allen et al.
6,240,583 B1 6/2001 Brooke et al.
6,289,537 B1 9/2001 Hopper et al.
6,315,319 B1 11/2001 Hanson et al.
6,336,235 B1 1/2002 Ruehl
6,374,436 B1 4/2002 Foster et al.
6,397,416 B2 6/2002 Brooke et al.
6,427,264 B1 8/2002 Metz et al.
6,446,287 B2 9/2002 Borders
6,496,993 B2 12/2002 Allen et al.
6,565,112 B2 5/2003 Hanson et al.
6,668,402 B2 12/2003 Heimbrock
6,675,418 B1 1/2004 Armstrong
6,684,427 B2 2/2004 Allen et al.
6,691,350 B2 2/2004 Weismiller
6,694,548 B2 2/2004 Foster et al.
6,704,954 B2 3/2004 Metz et al.
6,725,474 B2 4/2004 Foster et al.
6,726,279 B1 4/2004 Figel et al.
6,728,985 B2 5/2004 Brooke et al.
6,789,280 B1 9/2004 Paul
6,817,363 B2 11/2004 Biondo et al.
6,820,293 B2 11/2004 Alverson
6,829,793 B2 12/2004 Brooke et al.
6,846,042 B2 1/2005 Hanson et al.
6,860,281 B1 3/2005 Clift
6,874,179 B2 4/2005 Hensley et al.
6,948,202 B2 9/2005 Weismiller
6,961,972 B2 11/2005 Pendell
6,978,499 B2 12/2005 Gallant et al.
7,000,272 B2 2/2006 Allen et al.
7,017,208 B2 3/2006 Weismiller et al.
7,020,920 B2 4/2006 Armstrong
7,028,354 B2 4/2006 Nygren et al.
7,032,265 B2 4/2006 Miller
7,039,971 B2 5/2006 Sebastien
7,073,220 B2 7/2006 Simmonds et al.
7,076,818 B2 7/2006 Kummer et al.
7,107,636 B2 9/2006 Metz et al.
7,150,058 B2 12/2006 Rabska et al.
7,171,709 B2 2/2007 Weismiller
7,213,279 B2 5/2007 Weismiller et al.
7,216,384 B2 5/2007 Allen et al.
7,234,182 B2 6/2007 Miller et al.
7,237,287 B2 7/2007 Weismiller et al.
7,243,386 B2 7/2007 Gallant et al.
7,325,265 B2 2/2008 Hornbach et al.
7,343,916 B2 3/2008 Biondo et al.
7,350,248 B2 * 4/2008 Hensley ..... A61G 7/0507 5/430
7,406,729 B2 8/2008 Hornbach et al.
7,430,771 B2 10/2008 Heimbrock
7,452,032 B1 11/2008 Roleder et al.
7,458,119 B2 12/2008 Hornbach et al.
7,472,445 B2 1/2009 Miller
7,480,951 B2 1/2009 Weismiller et al.
7,512,998 B2 4/2009 Martin et al.

(56) References Cited

U.S. PATENT DOCUMENTS

| | | | |
|---|---|---|---|
| 7,523,515 | B2 | 4/2009 | Allen et al. |
| 7,536,738 | B2 | 5/2009 | Richards et al. |
| 7,568,246 | B2 | 8/2009 | Weismiller et al. |
| 7,568,249 | B1 | 8/2009 | Kunde et al. |
| 7,600,817 | B2 | 10/2009 | Kramer et al. |
| 7,636,966 | B2 | 12/2009 | Gallant et al. |
| 7,665,166 | B2 | 2/2010 | Martin et al. |
| 7,676,862 | B2 | 3/2010 | Poulos et al. |
| 7,690,059 | B2 | 4/2010 | Lemire et al. |
| 7,703,158 | B2 | 4/2010 | Wilker, Jr. et al. |
| 7,730,562 | B2 | 6/2010 | Hornbach et al. |
| 7,743,441 | B2 | 6/2010 | Poulos et al. |
| 7,757,318 | B2 | 7/2010 | Poulos et al. |
| 7,774,873 | B2 | 8/2010 | Martin et al. |
| 7,779,494 | B2 | 8/2010 | Poulos et al. |
| 7,784,128 | B2 | 8/2010 | Kramer |
| 7,788,748 | B2 | 9/2010 | Wurdeman |
| 7,805,784 | B2 | 10/2010 | Lemire et al. |
| 7,805,789 | B1 | 10/2010 | Dean |
| 7,861,334 | B2 | 1/2011 | Lemire et al. |
| 8,322,342 | B2 | 12/2012 | Soto et al. |
| 8,745,786 | B2 | 6/2014 | Andrienko et al. |
| 2001/0027578 | A1 | 10/2001 | Brooke et al. |
| 2002/0002742 | A1 | 1/2002 | Osborne et al. |
| 2002/0095728 | A1 | 7/2002 | Weismiller |
| 2003/0024048 | A1 | 2/2003 | Heimbrock |
| 2003/0056293 | A1 | 3/2003 | Brooke et al. |
| 2003/0167568 | A1 | 9/2003 | Brooke |
| 2004/0168254 | A1 | 9/2004 | Rabska et al. |
| 2005/0015879 | A1 | 1/2005 | Cuschieri et al. |
| 2005/0120485 | A1 | 6/2005 | Sebastien |
| 2006/0085914 | A1 | 4/2006 | Peterson et al. |
| 2006/0130238 | A1 | 6/2006 | Smith |
| 2006/0130239 | A1 | 6/2006 | Smith |
| 2006/0168727 | A1 | 8/2006 | Heimbrock |
| 2007/0151032 | A1 | 7/2007 | Heavrin |
| 2009/0007332 | A1 | 1/2009 | Wu et al. |
| 2009/0199339 | A1 | 8/2009 | Barr |
| 2009/0229049 | A1 | 9/2009 | Heimbrock et al. |
| 2010/0000016 | A1 | 1/2010 | Aiken et al. |
| 2010/0242176 | A1 | 9/2010 | Newkirk et al. |
| 2011/0185507 | A1 | 8/2011 | Abernathey et al. |
| 2012/0073051 | A1 | 3/2012 | Lachenbruch et al. |

FOREIGN PATENT DOCUMENTS

| | | | |
|---|---|---|---|
| EP | 1693037 | B1 | 1/2013 |
| WO | 8202832 | A1 | 9/1982 |
| WO | 0147340 | A2 | 7/2001 |
| WO | 03015686 | A1 | 2/2003 |
| WO | 03032777 | A1 | 4/2003 |
| WO | 2006025245 | A1 | 3/2006 |
| WO | 2006058506 | A1 | 6/2006 |

* cited by examiner

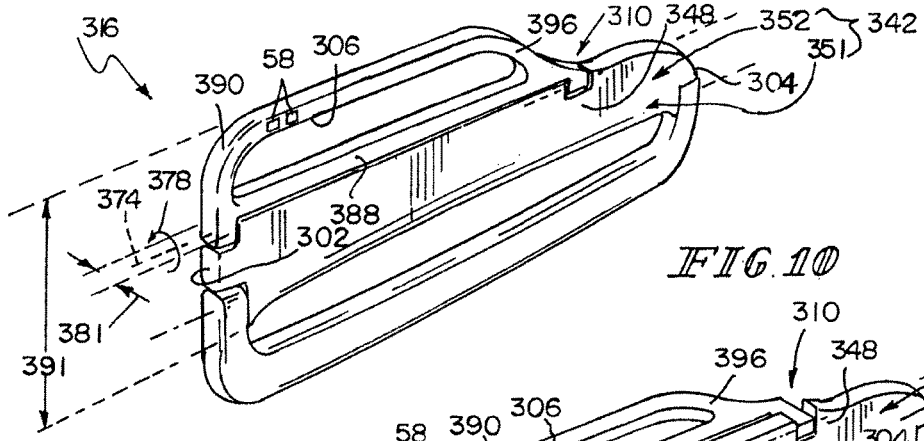
FIG. 10
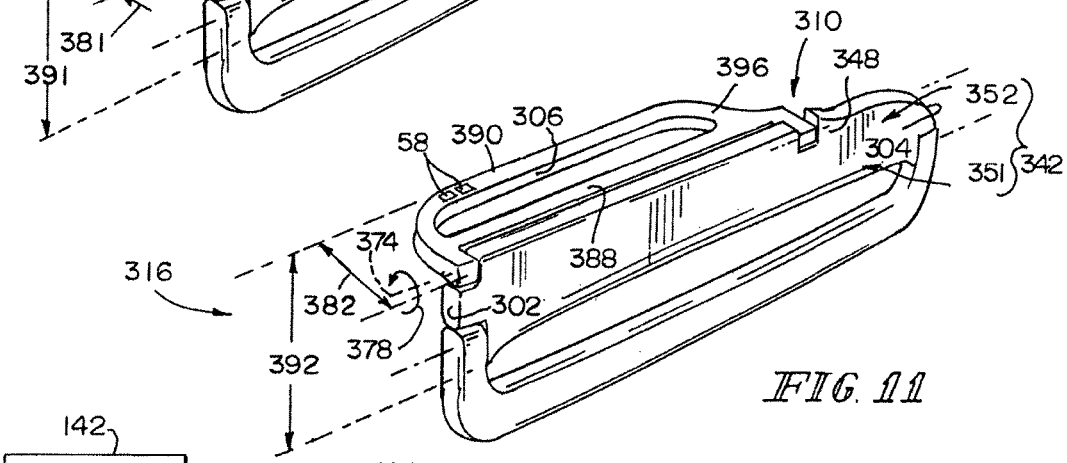
FIG. 11
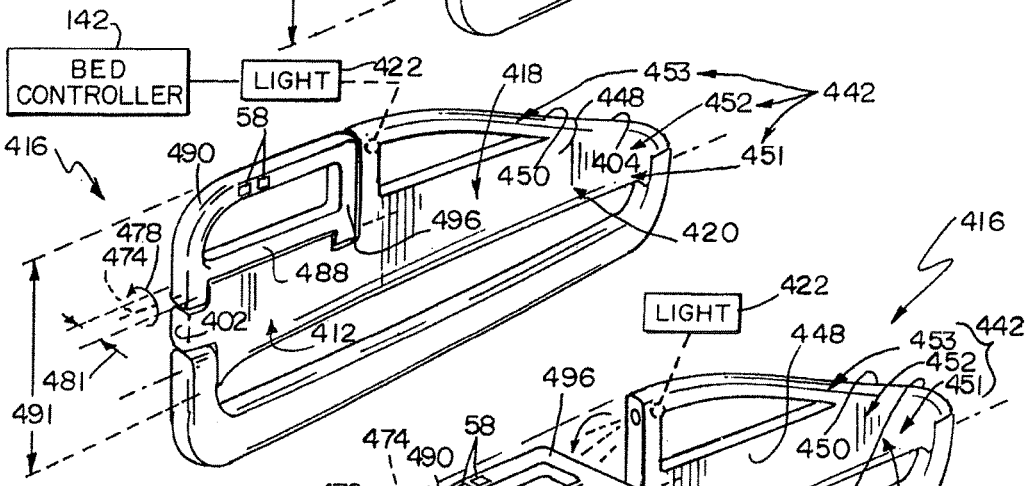
FIG. 12
FIG. 13

SIDERAIL ASSEMBLY FOR PATIENT SUPPORT APPARTATUS

RELATED APPLICATIONS

This application is a continuation of U.S. patent application Ser. No. 12/943,482, filed Nov. 10, 2010, now U.S. Pat. No. 8,745,786, which is incorporated herein by this reference.

BACKGROUND

The present disclosure is related to a support apparatus for supporting a patient. More particularly, the present disclosure relates to a bed that can be manipulated to achieve both a conventional bed position having a horizontal support surface and a chair position having the feet of the patient on or adjacent to the floor and the head and back of the patient supported above a seat formed by the bed.

It is known to provide beds that have a head siderail assembly coupled to a head portion of the support surface and a foot siderail assembly coupled to a seat portion of the support surface. The siderail assemblies may be movable independently of one another between a raised position and a lowered position. The siderail assemblies may be used in the raised position to retain patients resting on the support surface and in the lowered position to transfer patients from the bed to another support apparatus, allow a caregiver improved access to the patient, or to help with entering and exiting the bed.

It is also known that patients egress from a side of the bed. Before the patient is able to egress, the patient must rotate the patient's body on the support surface to face toward the side, swing the patient's legs over the side of the bed, and remain sitting in an upright position without support from the support surface to the patient's back. Such coordinated movement to egress from the side of the bed may be difficult for some patients. As a result, egress from the chair position of the bed may be more suitable to some patients. With the bed in the chair position, the patient begins with the patient's feet resting on the floor, the patient sitting in the upright position, and the patient's back being supported by the support surface. To egress from the bed, the patient supports a portion of the patient's weight on the support surface on each side of the patient or on a caregiver standing next to the bed. The patient then leans forward and transfers the remaining weight to the patient's feet.

SUMMARY

This application discloses one or more of the features recited in the appended claims and/or the following features which, alone or in any combination, may comprise patentable subject matter.

According to one aspect of the present disclosure, a siderail assembly for a patient support apparatus includes a guide, a support, a barrier, and a handle. The guide mounts to a frame of the patient support apparatus and the support is coupled to the guide to move relative to the guide. The barrier is coupled to the support to pivot about a generally horizontal axis between a raised position and a lowered position. The barrier is coupled to the support to pivot about a generally horizontal axis between a raised position and a lowered position. The barrier includes an outward side that faces away from a deck included in the patient support apparatus and an inward side that faces toward the deck. The handle is coupled to the barrier to move relative to the barrier between a storage position and an egress position. The handle, when in the storage position, lies in a generally vertically plane with the barrier. The handle, when in the egress position, extends away from the inward side of the barrier and lies in a generally horizontal plane.

In some embodiments, the pivot axis is spaced-apart from and generally parallel to the horizontal axis. The handle may move about the pivot axis from the storage position to the egress position.

The handle may include a handle mount, a forward grip, and a lateral grip. The handle mount may be coupled to the barrier to move about the pivot axis relative to the barrier. The forward grip may be coupled to the handle mount to move therewith. The lateral grip may be coupled to both the forward grip and the handle mount to move therewith.

The handle mount may include a first pivot joint, a second pivot joint, and a bar. The bar may be positioned between and interconnecting the first and second pivot joints. The first pivot joint may couple the bar to the barrier. The second pivot joint may couple the bar to the barrier. The forward grip, the lateral grip, and the handle mount may cooperate together to define an aperture that may be configured to receive a patient's hand therein.

In some embodiments, the handle mount includes a pivot joint and a bar. The pivot joint may lie between and interconnect the bar to the barrier for movement relative to the barrier. The forward grip and the lateral grip may be coupled to the bar to move therewith. The bar may cantilever away from the pivot joint toward a foot end of the patient support apparatus.

The outward side of the barrier may be formed to include a recess. The recess may be configured to receiver and mate with a portion of the handle when the handle is in the storage position.

The siderail assembly may further include a handle lock. The handle lock may be coupled to the barrier to move therewith. The handle lock may be movable between a locked position and a freed position. The handle lock may retain the handle in place when in the locked position. The handle lock may allow the handle to move freely relative to the barrier when then handle lock is in the freed position.

In some embodiments, the handle lock includes a plunger, a receiver, and a bias spring. The plunger may be coupled to the barrier to move relative to the barrier. The receiver may be formed in the handle and may be configured to mate with the plunger when the handle lock is in the locked position. The bias spring may be coupled to the plunger to provide a bias force to the plunger to urge the plunger to mate with the receiver. The handle lock may further include an actuator button. The actuator button may be coupled to the barrier panel to move back and forth in a lateral direction relative to the barrier panel. The actuator button may be configured to apply an actuation force to the plunger to overcome the bias force and move the plunger from the locked position to the freed position.

In another aspect of the present disclosure, a siderail assembly for a patient support apparatus includes a linkage, a barrier, and a handle. The linkage mounts to a side of a patient support apparatus and the side extends between a foot and a head end of the patient support apparatus. The barrier is movable between a raised position and a lowered position. The barrier includes a foot edge, a spaced-apart head edge, a first portion, and a second portion. The first portion is coupled to the linkage and extends between the foot and the head edges. The second portion is appended to the first portion, extends between the foot and the head edges, and extends upwardly away from the first portion.

The handle is coupled to the barrier to rotate in a counter-clockwise direction about a pivot axis relative to the barrier from a storage position to an egress position. The handle, when storage position, lies in a substantially vertical plane. The vertical plane extends between the head and the foot ends of the patient support apparatus. The handle, while still in the storage position, cooperates with the barrier to define a first barrier width. The handle, when in the egress position, lies in a substantially horizontal plane. The horizontal plane lies orthogonal to the vertical plane. The handle, while still in the egress position, cooperates with the barrier to define a second barrier width. The second barrier width is greater than the first barrier width.

In some embodiments, the barrier further includes a third portion. The third portion may be appended to the second portion to locate the second portion between the first and the third portions. The third portion may extend upwardly away from the first and second portions. The handle may be coupled to the third portion. The pivot axis may be spaced-apart above the second portion of the barrier. The third portion of the barrier may be formed to include an aperture that may receive a patient's hand therein.

The handle may be coupled to the third portion of the barrier. The handle may extend away from the foot edge of the barrier toward a middle point of the barrier. The middle point may be spaced-apart from and between the foot and head edges of the barrier. The barrier may include an outward side and an oppositely facing inward side. The outward side may be formed to include a recess that is configured to mate with the handle when the handle is in the storage position.

The handle may be coupled to the second portion of the barrier to locate the second portion between the handle and the first portion. The handle may extend upwardly away from the second portion when then handle is in the storage position. The handle may extend between the foot and the head edges of the barrier. The handle may extend from the foot edge of the barrier toward a middle point of the barrier. The middle point of the barrier may be between the foot and the head edges of the barrier.

In another aspect of the present disclosure, a siderail assembly for a patient support apparatus includes a guide, a support, a barrier, and a handle. The guide is coupled to the frame in a fixed position. The support is coupled to the guide to move relative to the guide. The barrier is coupled to the support to move between a raised position and a lowered position while the barrier remains in a substantially vertical orientation. The barrier includes an outward side and an oppositely facing inward side. Then handle is coupled to the foot end of the barrier to pivot about a pivot axis relative to the barrier between a storage position, a barrier-extension position, a side-use position, and an egress position. The handle, when in the storage position, lies in generally coplanar relation with the barrier and cooperates with the barrier to establish a first barrier height and a first barrier width. The handle, when in the barrier-extension position, extends upwardly away from the barrier and cooperates with the barrier to establish a second barrier height which is greater than the first barrier height. The handle, when in the side-use position, extends away from the outward side of the barrier and cooperates with the barrier to define a third barrier height and a third barrier width which is greater than the first and second barrier widths. The handle, when in the egress position, extends away from the inward side of the barrier and cooperates with the barrier to establish a fourth barrier height which is about equal to the third barrier height and less than the second barrier height and a fourth barrier width which is about equal to the third barrier width and greater than the first width.

In some embodiments, the siderail assembly further includes a user interface that is coupled to the handle to move therewith. The user interface may be adapted to send a first input to a bed controller to control movement of the patient support apparatus in response to the first input.

The siderail assembly may further include a sensor. The sensor may be configured to sense a position of the handle relative to the barrier. The sensor may be configured to send a second input to a bed controller to control movement of the patient support apparatus in response to the second input.

Additional features alone or in combination with any other feature(s), including those listed above, those listed in the claims, and those described in detail below, may comprise patentable subject matter. Other features will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which:

FIG. 10 is an enlarged partial perspective view of another embodiment of a right foot siderail with the handle in the storage position;

FIG. 11 is a view similar to FIG. 10 with the handle in the egress position;

FIG. 12 is an enlarged partial perspective view of another embodiment of a right foot siderail with the handle in the storage position and the handle having a user interface;

FIG. 13 is a view similar to FIG. 12 with the handle in the egress position;

DETAILED DESCRIPTION OF THE DRAWINGS

Figure 1:
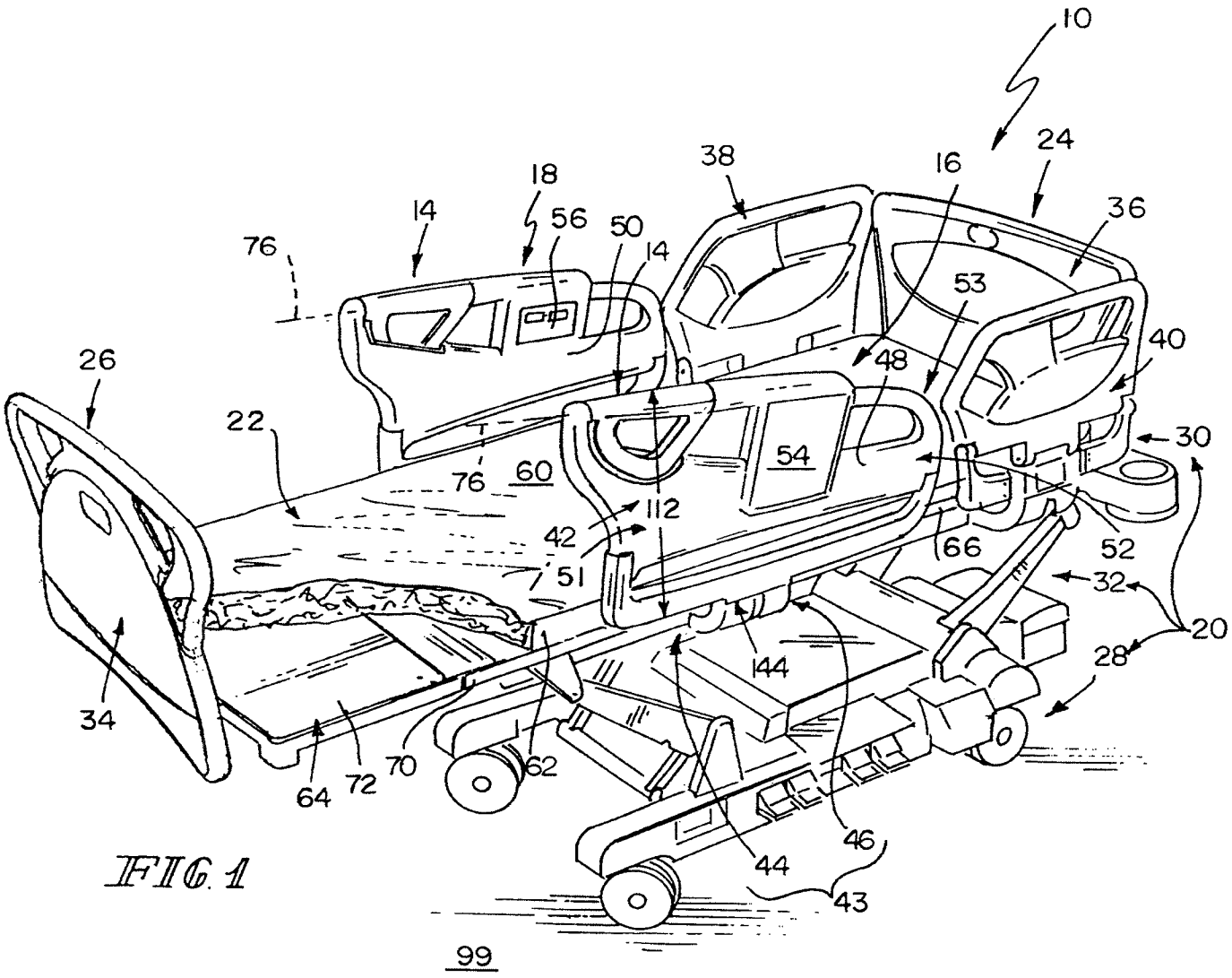
FIG. 1 is a perspective view of a patient support apparatus including four siderails in a raised position.
Figure 2:
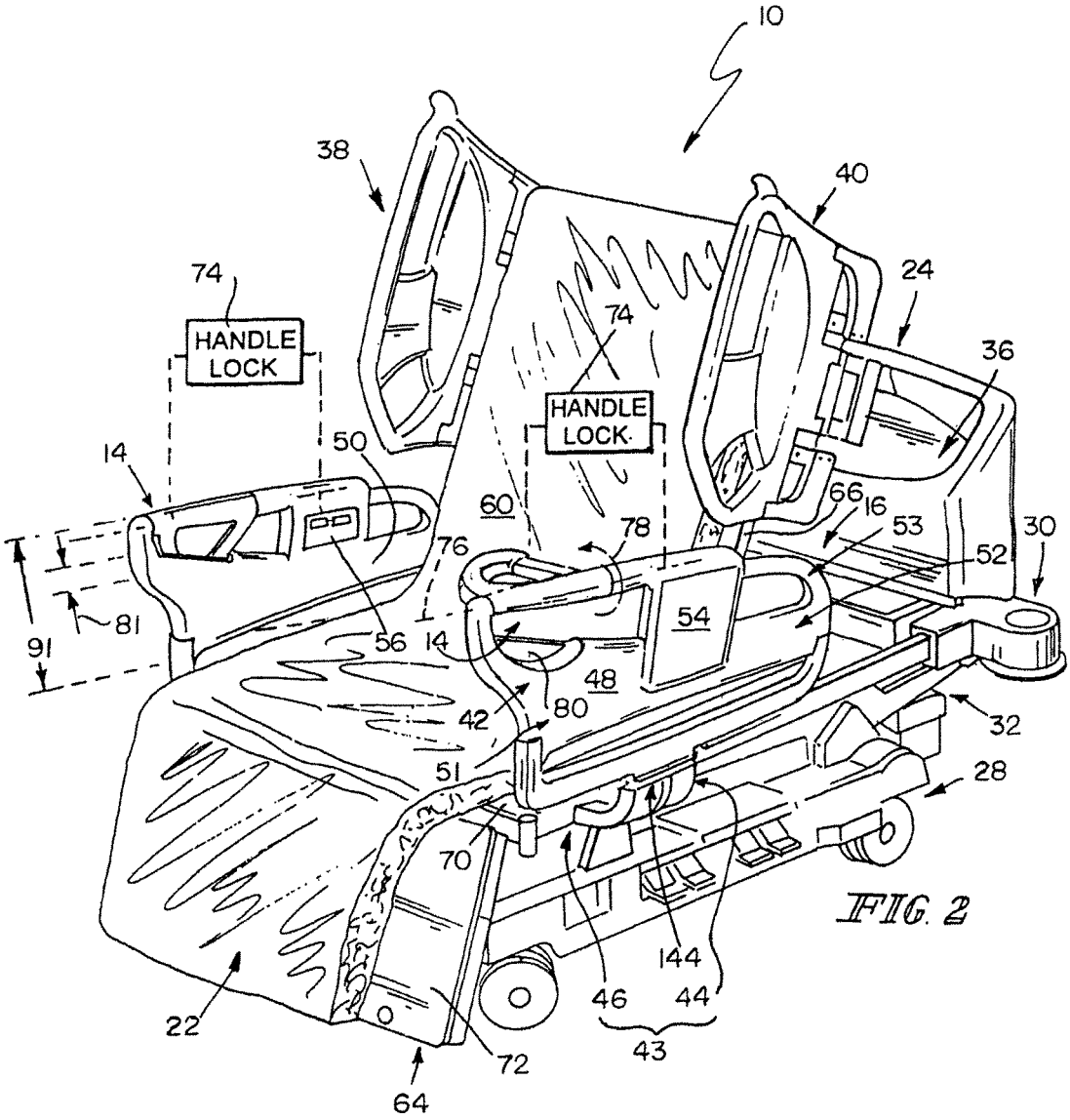
FIG. 2 is a perspective view of the patient support apparatus of FIG. 1 with each foot siderail including a handle in a storage position.

According to the present disclosure, a patient support apparatus, such as an illustrative hospital bed 10 is shown, for example, in FIGS. 1 and 2. The hospital bed 10 may be arranged to assume a bed position, as shown in FIG. 1, and a chair-egress position as shown in FIG. 2. The hospital bed 10, when in the bed position, provides support to a patient (not shown) such that the patient's feet are supported spaced-apart from the ground 99. The hospital bed 10, when in the chair-egress position, supports the patient in an upright position such that the patient sits with the patient's feet positioned on the ground 99. The chair-egress position is also used by patients and caregivers to help patients egress or exit the hospital bed 10. As an example, a movable handle 14 included in the foot siderail assemblies 16, 18 is movable between a storage position, shown in FIG. 2, and a egress position shown in FIG. 3. In the egress position, a patient may support a portion of his or her weight on the handles during egress from the hospital bed 10.

The hospital bed 10 includes a frame 20 and a mattress 22 that is supported by the frame 20 as shown in FIGS. 1 and 2. The hospital bed 10 has a head end 24 and a foot end 26. The frame 20 includes a base 28 and an upper frame 30 coupled to the base 28 by an elevation system 32. The elevation system 32 is operable to raise, lower, and tilt the upper frame 30 relative to base 28. The hospital bed 10 further includes a footboard 34 at the foot end 26 and a headboard 36 at the head end 24. Footboard 34 is removed prior to the hospital bed 10 being moved into the chair-egress position shown in FIG. 2.

The hospital bed 10 includes four siderail assemblies coupled to the upper frame 30: a patient-right head siderail assembly 38, the patient-right foot siderail assembly 18, a patient-left head siderail assembly 40, and a patient-left foot siderail assembly 16. Each of the siderail assemblies 16, 18, 38, and 40 is movable between a raised position, as the left foot siderail assembly 16 is shown in FIG. 1, and a lowered position as the right foot siderail assembly 18 is shown in FIG. 1. Siderail assemblies 16, 18, 38, and 40 are sometimes referred to as siderails 16, 18, 38, 40 herein.

The left foot siderail 16 is similar to the right foot siderail 18, and thus, the following discussion of the left foot siderail 16 is equally applicable to the right foot siderail 18. The left foot siderail 16 includes a barrier panel 42 and a linkage 43. As an example, the linkage 43 may include a support assembly and a guide assembly. The guide assembly is coupled to the upper frame 30 in a fixed position and is configured to guide the support assembly and the barrier panel during movement of the foot siderail 16 between the raised and the lowered positions. The support assembly interconnects the barrier panel 42 and the guide assembly to cause the barrier panel 42 to remain in a substantially vertical orientation during movement between the raised and the lowered positions.

The barrier panel 42, also called a barrier 42, includes an outward side 48 and an oppositely facing inward side 50. As shown in FIGS. 1 and 2, inward side 50 faces toward the mattress 22 and the outward side 48 faces away from the mattress 22. A first user interface 54 is coupled to the outward side 48 of the barrier panel 42 for use by a caregiver (not shown). As shown in FIG. 2, a second user interface 56 is coupled to the inward side 50 for use by a patient (not shown). Both the first and second user interfaces 54, 56 are coupled electrically to a bed controller 142 included in the hospital bed 10. The user interfaces 54, 56 are configured to allow caregivers and patients to control movement of the elevation system 32 as well as other features of the hospital bed 10.

Barrier panel 42 further includes a first portion 51, a second portion 52, and a third portion 53 as shown in FIGS. 1-5. Illustratively, first portion 51 is also called a bottom portion 51, second portion 52 is also called a medial portion 52, and third portion 53 is also called a top portion 53. The bottom portion 51 is coupled to the linkage 43 and extends upwardly therefrom. The medial portion 52 is appended to the bottom portion 51 and extends upwardly away from the bottom portion 51. The top portion 53 is appended to the medial portion 52 and is arranged to extend upwardly so that the medial portion 52 is located between the top and bottom portions 51, 53.

The mattress 22 of hospital bed 10 includes a top surface 60, a bottom surface (not shown), and a perimeter surface 62 as shown in FIGS. 1 and 2. The upper frame 30 of the frame 20 carries a deck 64 that engages the bottom surface of the mattress 22. The deck 64, as shown in FIG. 1, includes at least a head section 66, a seat section 68, a thigh section 70, and a foot section 72. For example, the head section 66 pivotably raises and lowers relative to the thigh section 70. Additionally, the thigh section 70 pivotably raises and lowers relative to the seat section 68. Also, the foot section 72 is extendable and retractable to change an overall length of the foot section 72, and therefore, to change an overall length of the deck 64.

In some embodiments, the seat section 68 also moves by translating on the upper frame 30 as the hospital bed 10 moves between the bed position and the chair-egress position. In those embodiments where the seat section 68 translates along the upper frame 30, the thigh and foot sections 70, 72 also translate along with the seat section 68. As the hospital bed 10 moves from the bed position to the chair-egress position, the foot section 72 lowers relative to the thigh section 70 and shortens in length. As the hospital bed 10 moves from the chair-egress position to the bed position, the foot section 72 raises relative to the thigh section 70 and increases in length. Thus, in the chair-egress position, the head section 66 extends generally vertically upwardly from the upper frame 30 and the foot section 72 extends generally downwardly from the thigh section 70 as shown in FIG. 2.

Figure 3:
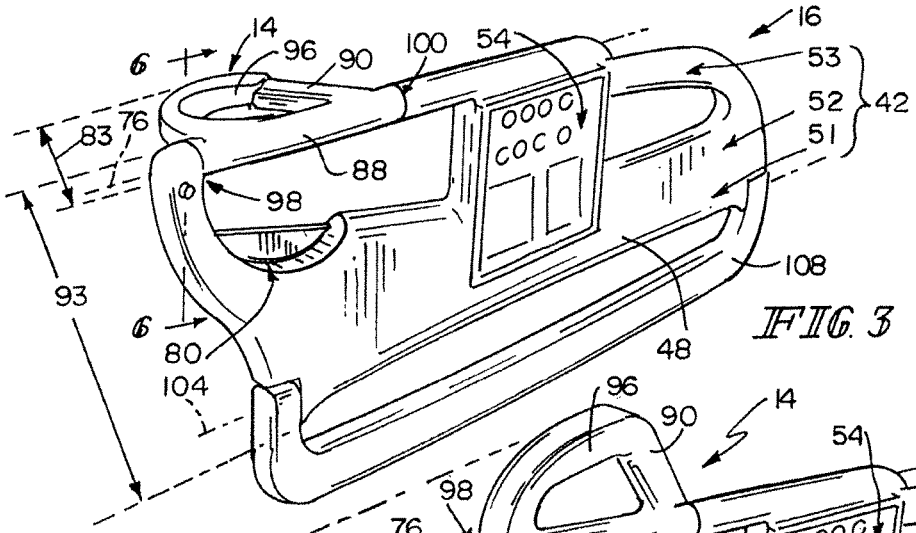
FIG. 3 is an enlarged partial perspective view of the right foot siderail of FIGS. 1 and 2 with the handle in a egress position.
Figure 4:
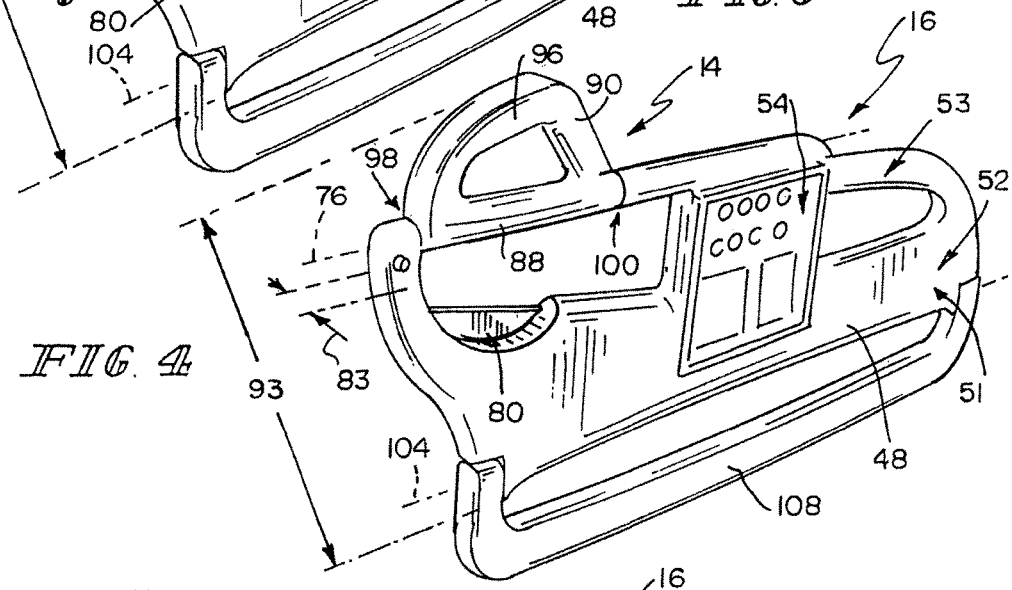
FIG. 4 is a view similar to FIG. 3 with the handle in the barrier-extension position.
Figure 5:
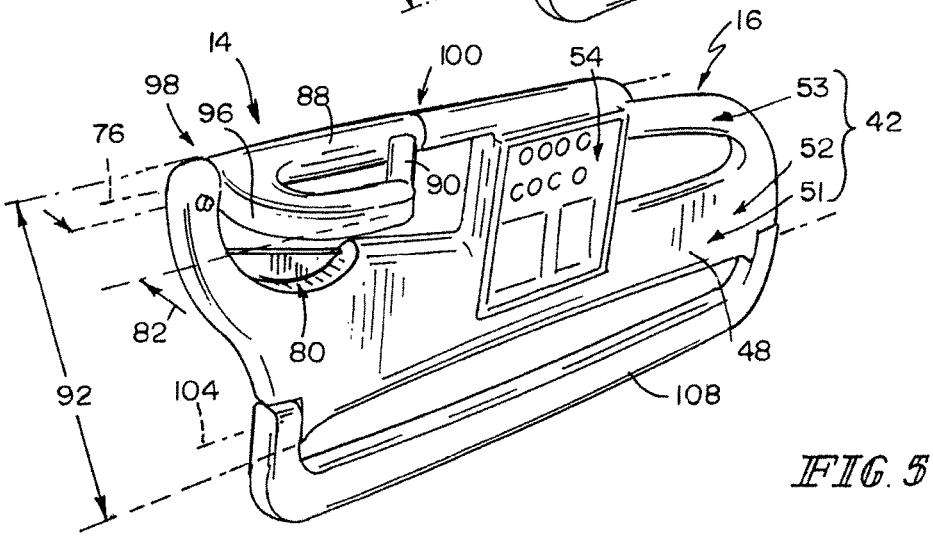
FIG. 5 is a view similar to FIG. 4 with the handle in the side-use position.

The left foot siderail assembly 16, as discussed previously, includes the barrier panel 42 and the linkage 43 as shown in FIGS. 1-5. The left foot siderail 16 further includes a handle 14 and a handle lock 74. The handle 14 is coupled to the barrier panel 42 to move selectively relative to the barrier panel 42 as shown in FIGS. 3-5. As an example, a caregiver disengages the handle lock 74 to allow the handle 14 to pivot about a handle-pivot axis 76 between a storage position as shown in FIGS. 1 and 2, an egress position as shown in FIG. 3, a barrier-extension position as shown in FIG. 4, and a side-use position as shown in FIG. 5. After the handle 14 is freed, the handle 14 moves from the storage position toward the egress position by pivoting about the handle-pivot axis 76 in a counter-clockwise direction 78 toward the mattress 22. Once the handle 14 has moved to a desired position, the caregiver allows the handle lock 74 to reengage so that unintended movement of the handle 14 relative to the barrier panel 42 is blocked.

The handle 14, when in the storage position, is at about zero degrees of rotation relative to the barrier panel 42. As shown in FIG. 2, the handle 14 lies in a recess 80 that is formed in the outward side 48 of the barrier panel 42. The handle 14 cooperates with the barrier panel 42 to define a first barrier width 81 and a first barrier height 91 as shown in FIG. 2. The handle 14 when in the storage position does not interfere with movement of the siderail 16 between the raised and the lowered positions. For example, the handle 14 is in the storage position when the hospital bed 10 is in the bed position and in the chair-egress position as shown in FIGS. 1 and 2.

The handle 14 moves from the storage position to a side-use position by rotating about 90 degrees in the counter-clockwise direction 78 about the handle-pivot axis 76 relative to the barrier panel 42. As shown in FIG. 5, the handle 14 extends away from the outward side 48 of the barrier panel 42 and away from the mattress 22 to lie in a generally horizontal plane. For example, a patient sitting in another chair spaced-apart from and adjacent to the hospital bed 10 uses the handle 14 in the side-use position to help the patient egress from the chair. In another example, a caregiver may hang additional equipment or supplies on the handle 14 when in the side-use position. The handle 14 cooperates with the barrier panel 42 to define a second barrier width 82 and a second barrier height 92 as shown in FIG. 5. The second barrier height 92 is about the same as the first barrier height 91 while the second barrier width 82 is greater than the first barrier width 81.

The handle 14 continues to move from the storage position to a barrier-extension position by rotating about 180 degrees in the counter-clockwise direction 78 about the handle-pivot axis 76. The handle 14, when in the barrier-extension position, acts as an extension of the barrier panel 42 so that egress of a patient resting in the hospital bed 10 is blocked further. As shown in FIG. 4, the handle 14 is in the barrier-extension position and cooperates with the barrier panel 42 to define a third barrier width 83 and a third barrier height 93. The third barrier width 83 is about equal to the first barrier width while the third barrier height 93 is greater than the first and second barrier heights 91, 92.

The handle 14 assumes the egress position by continuing to rotate to about 270 degrees in the counter-clockwise direction 78 from the storage position. Both handles 14 of the left and right foot siderails 16, 18 extend toward one another to minimize a distance between the foot siderails 16, 18. The minimized distance between the foot siderails 16, 18 allows a patient to grip the handles to support a portion of the patient's weight during egress from the hospital bed 10. For example, the hospital bed 10 is moved from the bed position to the chair-egress position before the handles 14 are moved to the egress position so that the handles 14 do not interfere with movement of the deck 64, the upper frame 30, or the elevation system 32. The handle 14 when in the egress position cooperates with the barrier panel 42 to define a fourth barrier width 84 and a fourth barrier height 94. The fourth barrier width 84 is about equal to the second barrier width 82 and the fourth barrier height 94 is about equal to the second barrier height 92.

As shown in FIG. 3, the handle 14 includes a handle mount 88, a forward grip 90, and a lateral grip 96. The handle mount 88 interconnects the forward and lateral grips 90, 96 to the top portion 53 of the barrier panel 42. When the handle 14 is in the egress position, the lateral grip 96 extends away from the inward side 50 toward the mattress 22. The forward grip 90 curves away from a distal end of the lateral grip 96 back to the handle mount 88.

The handle mount 88 includes a first pivot joint 98, a second pivot joint 100, and a bar 105. The first pivot joint 98 is coupled to a foot end of the bar 105 and the second pivot joint 100 is coupled to the opposite head end of the bar 105. The pivot joints 98, 100 interconnect the bar 105 and the top portion 53 of the barrier panel to cause the bar 105 and the grips 90, 96 to rotate about the handle-pivot axis 76. As shown in FIGS. 1-5, the first and second pivot joints 98, 100 define the handle-pivot axis 76 which is generally horizontal and parallel to a longitudinal axis of the hospital bed 10. The handle-pivot axis 76 extends along a top side of the top portion 53 of the barrier panel 42. As shown in FIGS. 3-5, the handle mount 88, the forward grip 90, and the lateral grip 96 cooperate to define an aperture 107 that receives a patient's hand therein during egress from the hospital bed 10.

As discussed previously, left foot siderail 16 may include the support assembly that interconnects the barrier panel 42 to the guide assembly. The support assembly, embodied as a link mechanism, includes a first upper link, a second upper link, and a lower link. The links interconnect the bottom portion 51 of the barrier panel 42 to the guide assembly to cause the barrier panel 42 to pivot between the raised and lowered positions. The first and second upper links are coupled to the barrier panel 42 to cause the barrier panel 42 to pivot about a first generally horizontal pivot axis 104. The lower link interconnects the barrier panel 42 and the guide assembly to cause the barrier panel 42 to pivot about a second generally horizontal pivot axis. When the foot siderail 16 is in the raised position, the first pivot axis 104 is spaced-apart above and parallel to the second pivot axis. The first and second pivot axes lie generally in parallel relation to the longitudinal axis of the hospital bed 10.

The support assembly further includes a barrier extender 108. The barrier extender 108 is coupled to the barrier panel 42 to pivot about the first pivot axis 104 and is coupled to the linkage 43 to move therewith. The handle-pivot axis 76 is spaced-apart above and generally parallel to the first pivot axis 104. The barrier extender 108 cooperates with the outward side 48 of the barrier panel 42 to establish an enlarged barrier surface having a raised height when the foot siderail 16 is in the raised position. The barrier extender 108 pivots with the linkage 43 under the deck 64 to reduce the height of the foot siderail 16 when foot siderail 16 is in the lowered position which is smaller than the raised height of the left foot siderail 16 so that a distance defined between the deck 64 and ground 99 is minimized.

Figure 6:
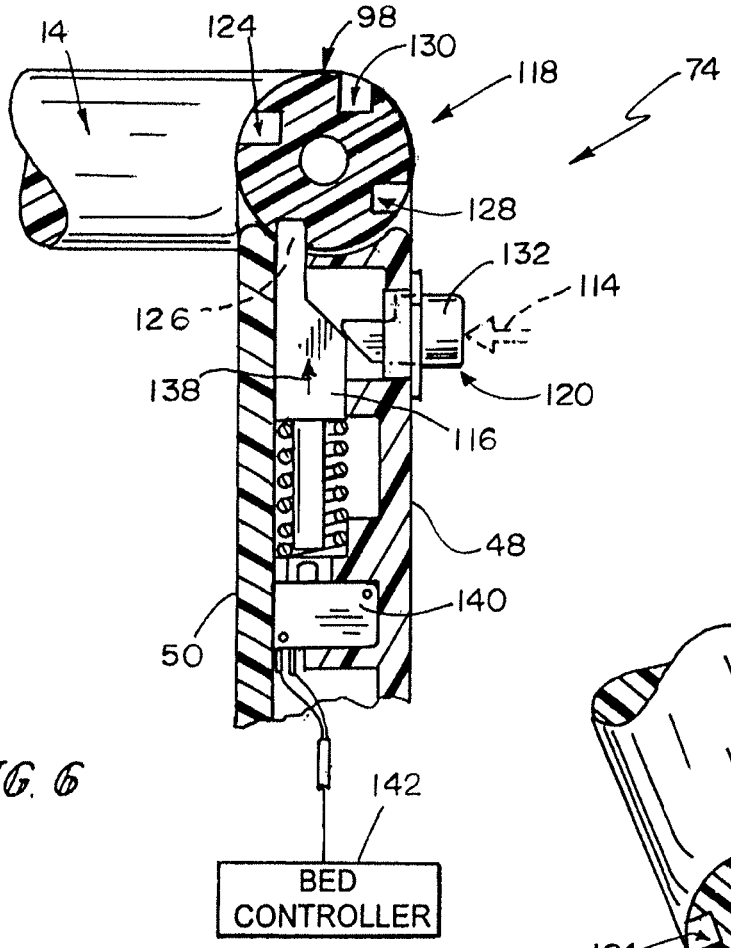
FIG. 6 is a sectional view taken along line 6-6 of FIG. 3 showing a handle lock in a locked position.
Figure 7:
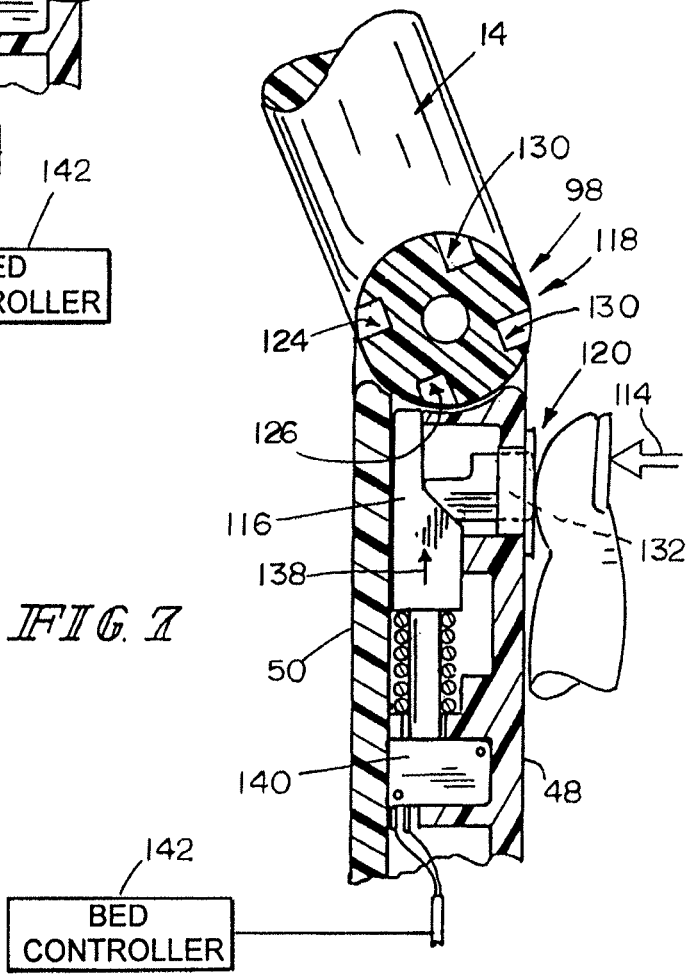
FIG. 7 is a view similar to FIG. 6 with the handle lock in the freed position.

The handle 14, as discussed previously, includes the handle lock 74 that is movable between the locked position shown in FIG. 6 and the freed position shown in FIG. 7. The handle lock 74 blocks movement of the handle 14 relative to the barrier panel 42 when the handle lock 74 is in the locked position. The handle 14 is free to pivot about the handle-pivot axis 76 when the handle lock 74 is in the freed position. A caregiver applies an actuation force 114 to the handle lock 74 to move the handle lock 74 from the locked position to the freed position as suggested in FIG. 6 and shown in FIG. 7.

The handle lock 74 includes a plunger 116, a receiver 118, and an actuator 120. The plunger 116 lies in a space 122 formed in the barrier panel 42 and mates with the receiver 118 when the handle lock 74 is in the locked position and is spaced-apart from the receiver 118 when the handle lock 74 is in the freed position. As shown in FIG. 6, receiver 118 includes a set of four slots 124, 126, 128, and 130 that are formed in the second pivot joint 100 of the handle 14. The first slot 124 is at about the six o'clock position in FIG. 6 and is associated with the handle 14 being in the egress position. The second slot 126 is at about the three o'clock position in FIG. 6 and is associated with the handle 14 being in the barrier-extension position. The third slot 128 is at about the twelve o'clock position in FIG. 6 and associated with the side-use position. The fourth slot 130 is at about the nine o'clock position in FIG. 6 and is associated with the storage position. The actuator 120 is coupled to the outward side 48 of the barrier panel 42 and moves back-and-forth relative to the barrier panel 42 to engage and move the plunger 116.

The actuator 120 of handle lock 74 includes an actuator button 132 and a bias spring 134. The actuator button 132 extends through an aperture 136 formed in the barrier panel 42 that opens into the space 122. The bias spring 134 is coupled the barrier panel 42 and to the plunger 116. The bias spring 134 provides a bias force 138 that urges the plunger 116 to mate with the receiver 118.

A caregiver uses the actuator button 132 to apply the actuation force 114 to the plunger 116 to overcome the bias force 138 and urge the plunger 116 away from the receiver 118. After the plunger 116 has moved away from the receiver 118, the handle 14 may move between the storage position and the egress position. After the caregiver removes the actuation force 114, the bias force 138 urges the plunger 116 to mate with the receiver 118 when the handle 14 moves to either the storage position or the egress position.

In other illustrative embodiments, the handle lock may be a Porter Group, LLC. MECHLOK® brand locking mechanism. The locking mechanism may be either actuated by a caregiver applying a manual actuation force or the actuation force may be provided by a powered actuator included in the hospital bed 10. The powered actuator may be coupled to the bed controller and configured to respond to commands sent by the bed controller. A user may disengage the handle lock to free the handles 14 to move to the egress position by using one of the user interfaces included in the hospital bed 10 to send an input to the bed controller to cause the powered actuator to provide the actuation force to the locking mechanism.

As shown in FIGS. 6 and 7, the handle 14 further includes a position sensor 140. The position sensor 140 is coupled electronically to a bed controller 142 also included in the hospital bed 10. As shown in FIGS. 6 and 7, the position sensor 140 senses the position of the plunger 116 relative to the barrier panel 42. The position of the handle 14 is determined as a result of slots 124, 126, 128, 130 all having different depths. As an example, the first slot 124 is deeper than the second slot 126. Thus, the position sensor 140 is able to sense when the handle 14 is in the storage position, the side-use position, the barrier position, and the egress position, and when the handle lock 74 is in the locked position and the freed position.

The position sensor 140 is coupled to the bed controller 142 to communicate the position of the handle 14 to the bed controller 142. The bed controller 142 is coupled electrically to the elevation system 32 to control vertical movement of the upper frame 30 relative to the base 28. The bed controller 142 also controls movement of the hospital bed 10 between the bed position and the chair-egress position. As a result of bed controller 142 being coupled to the position sensor 140, the bed controller 142 blocks movement of the elevation system 32 when the handle 14 is in the egress position so that damage to the foot siderails 16, 18 is minimized if contacted by the foot section 72 of the deck 64.

The left foot siderail 16 also illustratively includes at least one latching mechanism 144, as shown in FIGS. 1 and 2. The latching mechanism 144 releasably secures a portion of the foot siderail assembly 16, 18 to the frame 20 of the hospital bed 10. The latching mechanism 144 may releasably secure the barrier panel 42 in one or more positions. As an example, the latching mechanism 144 secures the barrier panel 42 in the raised position to block movement of the barrier panel 42 from the raised position to the lowered position. The latching mechanism may releasably secure a barrier panel with a support assembly, releasably secure the support assembly with the frame of the patient support apparatus, and releasably secure the support assembly with the guide assembly.

Figure 8:
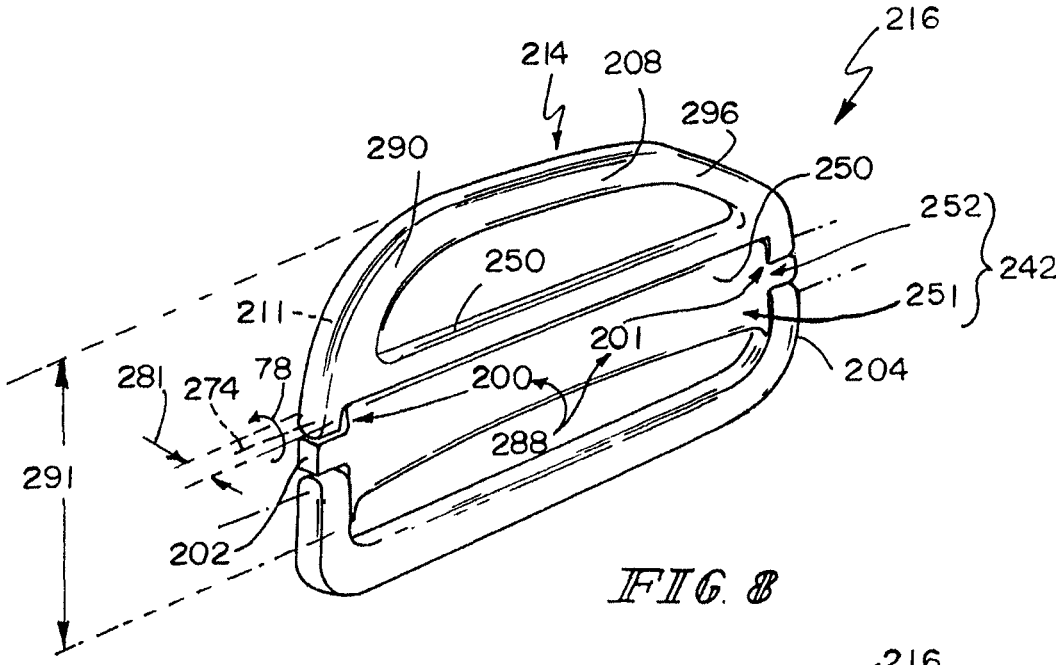
FIG. 8 is an enlarged partial perspective view of another embodiment of a right foot siderail with the handle in a storage position.
Figure 9:
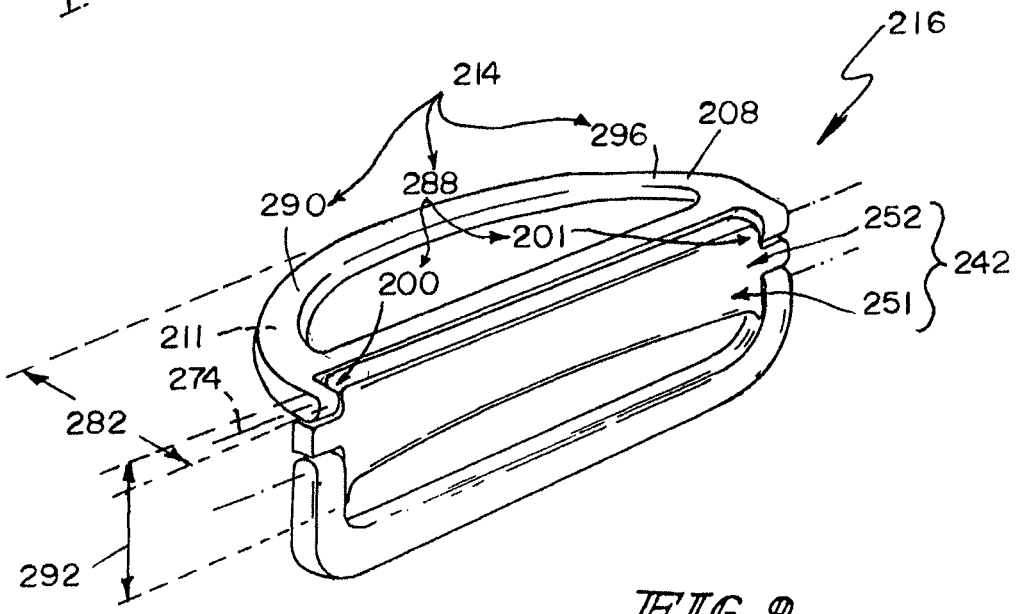
FIG. 9 is view similar to FIG. 8 with the handle in the egress position.

Another embodiment of a left foot siderail assembly 216 is shown in FIGS. 8 and 9. In the embodiment shown in FIGS. 8 and 9, the left foot siderail assembly 16 is omitted from the hospital bed 210 and replaced with left foot siderail 216. Left foot siderail 216 includes a handle 214 and a barrier panel 242. The barrier panel 242 includes a first portion 251 and a second portion 252. The first portion 251 is also called a bottom portion 251 and the second portion 252 is also called a medial portion 252. The medial portion 252 is appended to the bottom portion 251 and extends upwardly away from the bottom portion 252. The support assembly 244 is coupled to the bottom portion 252. The barrier panel 242 also includes an outward side 248 that faces away from the mattress 22, an oppositely facing inward side 250 that faces toward the mattress 22, a foot edge 202 that faces toward the foot end 26 of the hospital bed 210, and a head edge 204 that faces toward the head end 24 of the hospital bed 210. The foot edge 202 and the head edge 204 extend between and interconnect the inward and outward sides 248, 250 of the barrier panel 242.

The handle 214 is coupled to the medial portion 252 to move about a handle-pivot axis 274 in a counter-clockwise direction 78 from the storage position of FIG. 8 to the egress position of FIG. 9. The handle 214 includes a handle mount 288, a forward grip 290, and a lateral grip 296. The handle mount 288 interconnects the forward grip 290 and the lateral grip 296 to the barrier panel 242. The handle mount 288 includes also defines the handle-pivot axis 274. The handle mount 288 includes a first pivot joint 200 and a second pivot joint 201 spaced from the first pivot joint 200. The first and second pivot joints 200 and 201 interconnect the handle mount 288 to the medial portion 252. When the handle 214 is in the storage position, the handle 214 extends upwardly from the medial portion 252 of the barrier panel 242 and acts like the top portion 53 of the barrier panel 42.

As shown in FIG. 8, the handle 214 is in the storage position and cooperates with the barrier panel 242 to define a first barrier width 281 and a first barrier height 291. The first barrier width 281 extends between the foot edge 202 and the head edge 204. The handle 214 of siderail 216 also extends between the foot edge 202 and the head edge 204. An aperture 206 is defined by the forward grip 290, the lateral grip 296, and the handle mount 288. The aperture 206 extends along a length of the handle 214 such that a patient may grasp the handle 214 near the head edge 204 of the barrier panel 242 and slide the patient's hand along the length of the handle 214 to the foot edge 202 without interruption.

The handle 214 is moved to the egress position after a caregiver disengages a handle lock. The handle 214 when in the egress position cooperates with the barrier panel 242 to define a second barrier width 282 and a second barrier height 292 as shown in FIG. 9. The second barrier width 282 is greater than the first barrier width 281 as a result of the handle 214 extending away from the inward side 250 of the barrier panel 242 toward the mattress 22. The second barrier height 292 is less than the first barrier height 291.

The handle 214 when in the egress position supports a portion of a patient's weight during a patient's egress from the hospital bed 210 when the hospital bed 210 is in the chair-egress position. The handle 214 also supports a patient's arms resting on a first side 208 of the handle 214. The first side 208 of the handle 214 faces upwardly when the handle 214 is in the egress position and lies in coplanar relation to the outward side 248 of the barrier panel 242 when the handle 214 is in the storage position. The handle 214 also includes an oppositely facing second side 211 which faced downwardly when the handle 214 is in the egress position and faces the outward side 248 of the barrier panel 242 when the handle 214 is in the storage position.

Another embodiment of a left foot siderail assembly 316 is shown in FIGS. 10 and 11. In the embodiment shown in FIGS. 10 and 11, the left foot siderail assemblies 16, 216 are omitted from the hospital bed 310 and replaced with the left foot siderail 316. The left foot siderail 316 includes a handle 314 and a barrier panel 342. The barrier panel 342 includes a first portion 351 and a second portion 352. The first portion 351 is also called a bottom portion 351 and the second portion 352 is also called a medial portion 352. The medial portion 352 and bottom portion 351 are similar to the medial and bottom portions 251, 252, and thus, the previous discussion of the medial and bottom portions 251, 252 is equally applicable. The barrier panel 342 also includes an outward side 348 that faces away from the mattress 22, an oppositely facing inward side 350 that faces toward the mattress 22, a foot edge 302 that faces toward the foot end 26 of the hospital bed 310, and a head edge 304. The head edge 304 of the barrier panel 342, unlike the head edge 204 of the barrier panel 242, has a convex shape that faces both upwardly and toward the head end 24.

The handle 314 is coupled to the medial portion 352 to move about a handle-pivot axis 374 in a counter-clockwise direction 378 from the storage position of FIG. 10 to the egress position of FIG. 11. The handle 314 includes a handle mount 388, a forward grip 390, and a lateral grip 396. The handle mount 388 interconnects the forward grip 390 and the lateral grip 396 to the barrier panel 342. The handle mount 388 also defines the handle-pivot axis 374 that extends along a top side of the medial portion 352.

When the handle 314 is in the storage position, the handle 314 extends upwardly from the medial portion 352 of the barrier panel 342. As shown in FIG. 10, the handle 314 is in the storage position and cooperates with the barrier panel 342 to define a first barrier width 381 and a first barrier height 391. Unlike the handle 214 of the siderail 216, the handle 314 of the siderail 318 extends between the foot edge 302 and a middle point 310 of the barrier panel 342. The middle point 310 is spaced-apart from and between the foot edge 302 and the head edge 304. The handle 314 in comparison to the handle 214 has a relatively shorter length.

The forward grip 390, the lateral grip 396, and the handle mount 388 cooperate to define an aperture 306 that runs along a length of the handle 314. As a result, a patient may grasp the handle 314 near the middle point 310 of the barrier panel 342 and slide their hand along the length of the handle 314 toward the foot edge 302 without interruption.

The handle 314 when in the egress position, as shown in FIG. 11, supports a portion of a patient's weight during a patient's egress from the hospital bed 310 when the hospital bed 310 is the chair-egress position. The length of handle 314 is configured to allow the head section 66 of the deck 64 to pivot upwardly relative to the upper frame 30 without causing interferences between the left head siderail 40 and the left foot siderail 316. For example, the curved convex head edge 304 of the barrier panel 342 also provides a grip for patients resting in the hospital bed 310 to use to reposition themselves on the mattress 22 when the hospital bed 310 is in the bed position.

The handle 314 when in the egress position cooperates with the barrier panel 342 to define a second barrier width 382 and a second barrier height 392 as shown in FIG. 11. The second barrier width 382 is greater than the first barrier width 381 as a result of the handle 314 extending away from the inward side 350 of the barrier panel 342 toward the mattress 22. The second barrier height 392 is less than the first barrier height 391.

Another embodiment of a left foot siderail assembly 416 is shown in FIGS. 12 and 13. The left foot siderail assemblies 16, 216, and 316 are omitted from the hospital bed 410 and replaced with the left foot siderail 416. Left foot siderail 416 includes a handle 414 and a barrier panel 442. The barrier panel 442 includes a first portion 451, a second portion 452, and a third portion 453. The first portion 451 is also called a bottom portion 451, the second portion 452 is also called a medial portion 452, and the third portion 453 is also called a top portion 453. The medial portion 452 and bottom portion 451 are similar to the medial and bottom portions 351, 352, and thus, the previous discussion of the medial and bottom portions 351, 352 is equally applicable. The top portion 453 is appended to the medial portion 452 to extend upwardly away from the medial portion 452. The barrier panel 442 also includes an outward side 448 that faces away from the mattress 22, an oppositely facing inward side 450 that faces toward the mattress 22, a foot edge 402 that faces toward the foot end 26 of the hospital bed 410, and a head edge 404 that faces the head end 24. The head and foot edges 402, 404 are similar to the head and foot edges 302, 304, and thus, the previous discussion of the head and foot edges 302, 304 is equally applicable.

The handle 414 is coupled to the medial portion 452 to move about a handle-pivot axis 474 in a counter-clockwise direction 478 from the storage position of FIG. 12 to the egress position of FIG. 13. The handle 414 includes a handle mount 488, a forward grip 490, and a lateral grip 496. The handle mount 488 interconnects the forward grip 490 and the lateral grip 496 to the barrier panel 442. The handle mount 488 also defines the handle-pivot axis 474 about which the handle 414 moves between the storage position and egress position. As shown in FIG. 12, the handle-pivot axis 474 is arranged to lie at an intersection of the top portion 453 and the medical portion 452.

When the handle 414 is in the storage position, the handle 414 extends upwardly from the medial portion 452 of the barrier panel 342. As shown in FIG. 12, the handle 414 is coupled to a foot portion 412 of the medial portion 452 of the barrier panel. The top portion 453 of the barrier panel 442 is coupled to a middle portion 418 of the medial portion 452. The curved convex head edge 404 defines a head portion 420 of the medial portion 452. Thus, the top portion 453 is between the handle 414 and the curved convex head edge 404. The handle 414, when in the storage position, cooperates with the barrier panel 442 to define a first barrier width 481 and a first barrier height 491.

The handle 414, when in the egress position of FIG. 13, supports a portion of a patient's weight during a patient's egress from the hospital bed 410 when the hospital bed 410 is the chair-egress position. The handle 414 cooperates with the barrier panel 442 to define a second barrier width 482 and a second barrier height 492 as shown in FIG. 13. The second barrier width 482 is greater than the first barrier width 481 as a result of the handle 414 extending away from the inward side 450 of the barrier panel 342 toward the mattress 22. The second barrier height 492 is about the same as the first barrier height 491 because the top portion 453 is fixed in position relative to the medial portion 452 and the handle 414.

The siderail 416 also includes a third user interface 58 that is mounted to the handle 414 and coupled electrically to the bed controller 142. The bed controller 142 is coupled electrically to the elevation system 32 to control movement of the upper frame 30 relative to the base 28 in response to inputs received from user interface 58 or the other user interfaces 54, 56 discussed previously. As an example, a patient may use the user interface 58 to move the hospital bed 410 from the chair-egress position to the bed position. The patient may also cause the hospital bed 410 to move from the chair-egress position to an egress-lift position in which the deck 64 is arranged in the chair-egress position, but the elevation system 32 tilts the upper frame 30 and the deck 64 upwardly to aid the patient during egress from the hospital bed 410. While the user interface 58 is shown with the handle 414 in FIG. 12, the user interface 58 may be used with any of the other handles disclosed herein.

As shown in FIGS. 12 and 13, the siderail 416 includes an alert light 422 that is coupled electrically to the bed controller 142 to provide light when called upon by the bed controller 142. The alert light is coupled to the barrier panel 442 to shine light on the handle 414. As an example, the bed controller 142 activates the alert light 422 when the hospital bed 410 is in the chair-egress position to alert a patient or caregiver that the handle 414 is available for use. Thus, the alert light 422 provides a reminder to users and helps patients use the handle 414 when ambient room light is low. The alert light 422 may be used with any of the handles disclosed herein.

Figure 14:
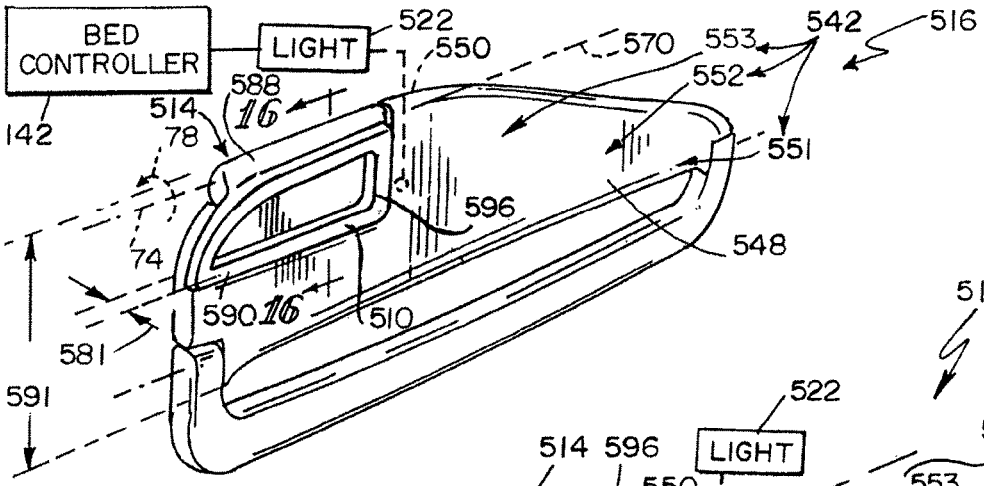
FIG. 14 is an enlarged partial perspective view of another embodiment of a left foot siderail assembly with the handle in the storage position and the handle including an alert light.
Figure 15:
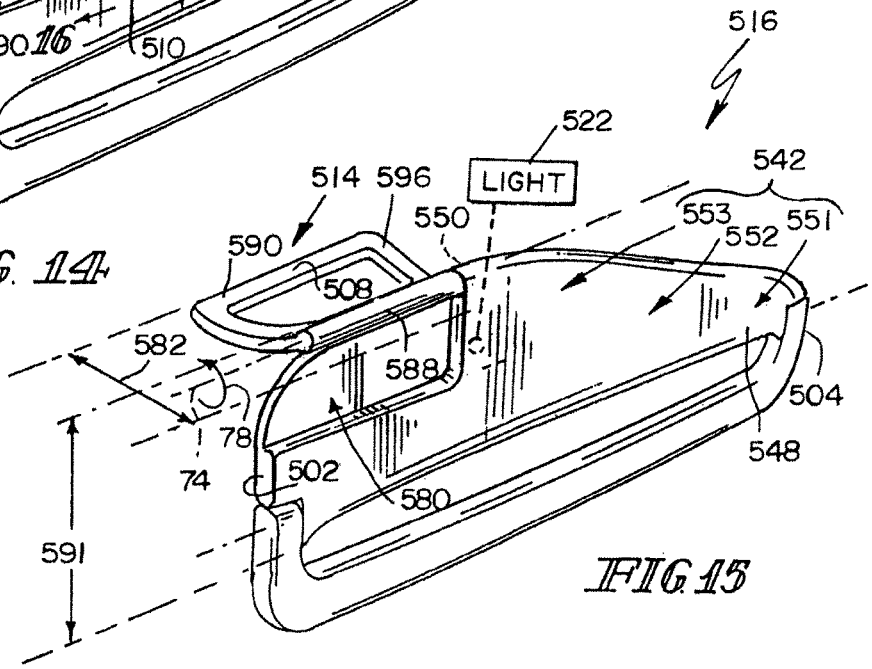
FIG. 15 is a view similar to FIG. 14 with the handle in the egress position.
Figure 16:
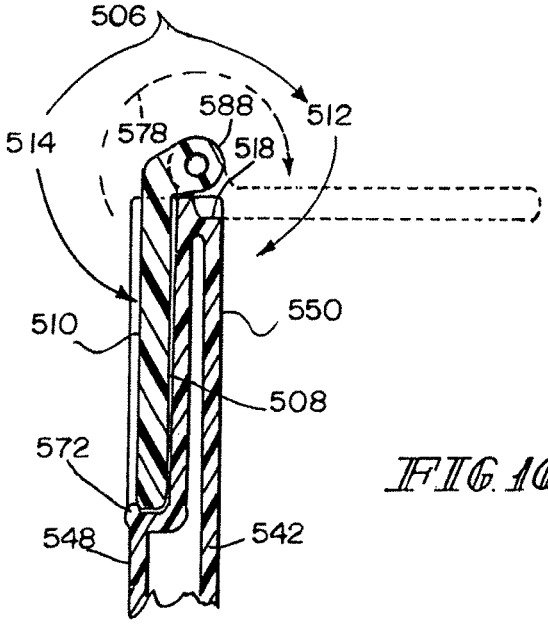
FIG. 16 is a sectional view taken about line 16-16 of FIG. 14 showing the handle retained in the storage position by a handle retainer.

Another embodiment of a left foot siderail assembly 516 is shown in FIGS. 14-16. The left foot siderail assemblies 16, 216, 316, and 416 are omitted from the hospital bed 510 and replaced with the left foot siderail 516. Left foot siderail 516 includes a handle 514 and a barrier panel 542. The handle 514, like the handle 14, is coupled the barrier panel 542 to move about the handle-pivot axis 74 between a storage position shown in FIG. 14 and an egress position shown in FIG. 15.

The barrier panel 542 includes a first portion 551, a second portion 552, and a third portion 553. The first portion 551 is also called a bottom portion 551, the second portion 552 is also called a medial portion 552, and the third portion 553 is also called a top portion 553. The medial portion 552 and bottom portion 551 are similar to the medial and bottom portions 351, 352, and thus, the previous discussion of the medial and bottom portions 352, 352 is equally applicable. The top portion 553 is appended to the medial portion 552 to extend upwardly away from the medial portion 552. The barrier panel 542 also includes an outward side 548 that faces away from the mattress 22, an oppositely facing inward side 550 that faces toward the mattress 22, a foot edge 502 that faces toward the foot end 26 of the hospital bed 510, and an opposite head edge 504 that faces toward the head end 502. The head and foot edges 502, 504 are similar to the head and foot edges 302, 304, and thus, the previous discussion of the head and foot edges 302, 304 is equally applicable.

The handle 514 is coupled to the medial portion 552 to move about the handle-pivot axis 74 in the counter-clockwise direction 78 from the storage position of FIG. 14 to the egress position of FIG. 15. The handle 514 includes a handle mount 588, a forward grip 590, and a lateral grip 596. The handle mount 588 interconnects the forward grip 590 and the lateral grip 596 to the barrier panel 542. The handle mount 588 also defines the handle-pivot axis 74 about which the handle 514 moves between the storage position and egress position. As shown in FIGS. 14 and 15, the handle-pivot axis 74 is spaced-apart above the medial portion 552 and extends along a top side of the top portion 553.

The handle 514, when in the storage position, mates with a recess 580 formed in the outward side 548 of the barrier panel 542. The handle 514 includes a first side 508 and an oppositely facing second side 510. The first side 508 of the handle 514 faces the barrier panel 542 and the second side 510 of the handle 514 lies in generally coplanar relation with the outward side 548 of barrier panel 542. The handle 514 and the barrier panel 542 cooperate to define a first barrier width 581 and a first barrier height 591 as shown in FIG. 14.

The handle 514, when in the egress position, extends away from the inward side 550 of the barrier panel 542 toward the mattress 22. The first side 508 faces upwardly and the second side 510 faces downwardly. Both the first and second sides 508, 510 define planes which are orthogonal to the planes defined by the inward and outward sides 548, 550 of the barrier panel 542. The handle 514 and the barrier panel 542 cooperate to define a second barrier width 582 and a second barrier height 592 as shown in FIG. 15. The second barrier width 582 is larger than the first barrier width 581. The second barrier height 592 is about the same as the first barrier height 591 because the handle 514 nests in the recess 580 of the barrier panel 542.

The siderail 516 further includes a handle-position controller 506 as shown in FIG. 16. The handle-position controller 506 includes a handle retainer 572 and a handle support 512. The handle retainer 572 is used to hold passively the handle 514 in the storage position. The handle support 512 is used to support passively the handle 514 in the egress position. Unlike the handle lock 74 of siderail 16, both the handle retainer 572 and the handle support 512 are passive mechanisms that do not require the caregiver to enable or disable them prior to movement of the handle 514.

As shown in FIG. 16, the handle retainer 572 is appended to the barrier panel 542 and extends into the recess 580. When the handle 514 is in the storage position, the handle retainer 572 engages the handle 514 and uses friction to retain the handle 514 in the storage position.

The handle support 512, as shown in FIG. 16, is a surface 518 included in the top portion 553 of the barrier panel 542. The surface 518 mates with a portion of the second side 510 of the handle 514. When the handle 514 is in the egress position, the second side 510 of the handle 514 lies in confronting relation with the surface 518. The surface 518 provides support as the handle 514 cantilevers away from the inward side 550 of the barrier panel 542. For example, a tab may be appended to the surface 518 of the top portion 553 and a mating recess may be formed in the second side 510 of the handle 514. The tab and recess are configured to cooperate to retain the handle in the egress position using a friction interference fit.

As shown in FIGS. 14 and 15, the siderail 516 includes an alert light 522 that is coupled electrically to the bed controller 142 to provide light when called upon by the bed controller 142. The alert light is coupled to the barrier panel 542 to shine light on the handle 514. As an example, the bed controller 142 activates the alert light 522 when the hospital bed 510 is in the chair-egress position to alert a patient or caregiver that the handle 514 is available for use. Thus, the alert light 522 provides a reminder to users and helps patients use the handle 514 when ambient room light is low. The alert light 514 may be used with any of the handles disclosed herein.

Figure 17:
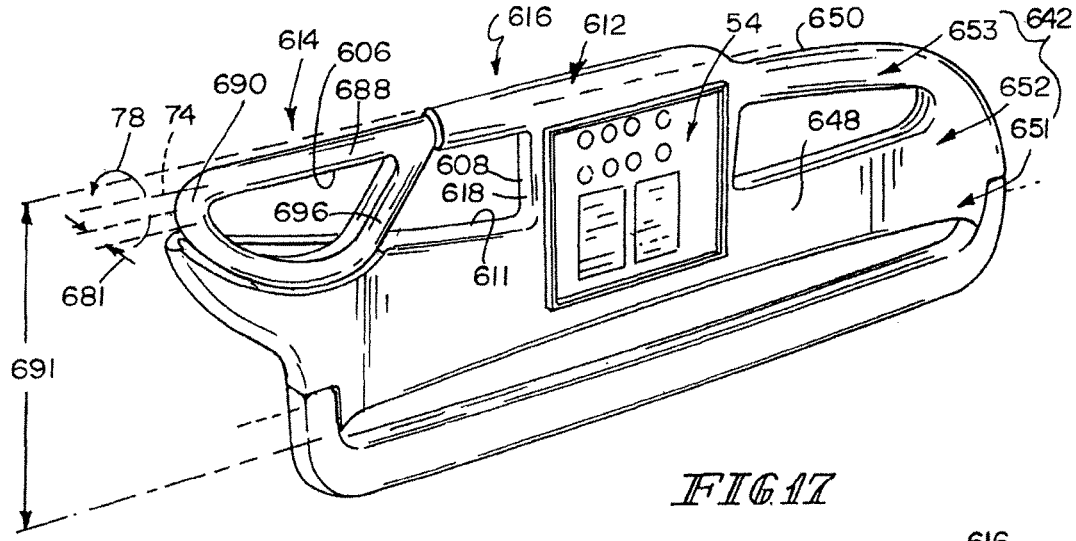
FIG. 17 is an enlarged partial perspective view of another embodiment of a left foot siderail assembly with the handle in the storage position.
Figure 18:
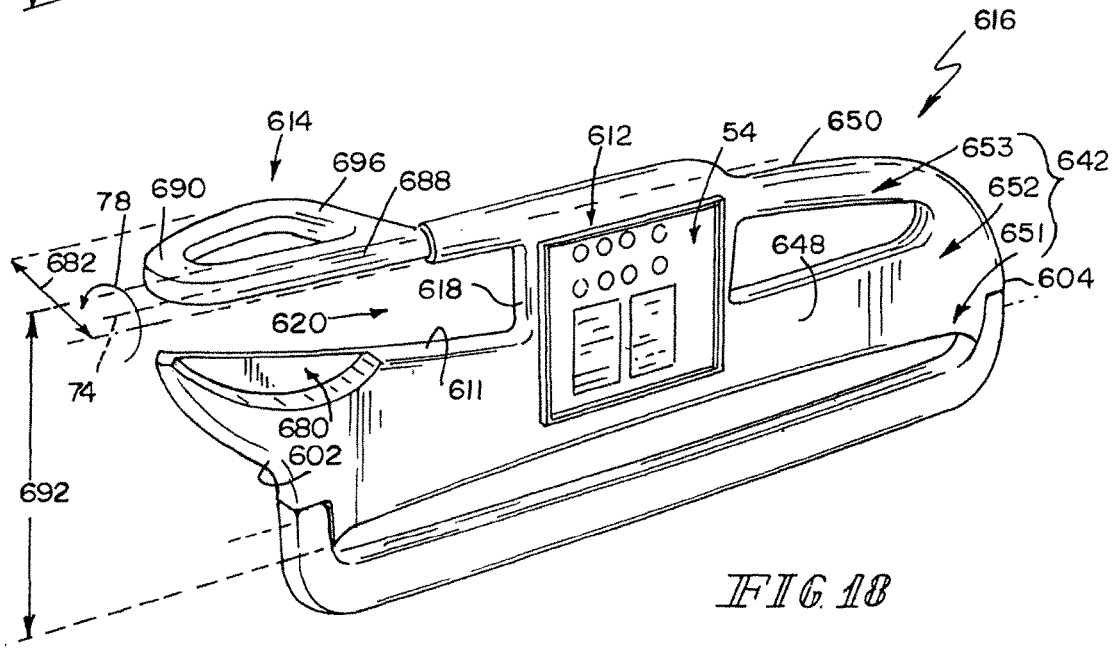
FIG. 18 is a view similar to FIG. 17 with the handle in the egress position.

Another embodiment of a left foot siderail assembly 616 is shown in FIGS. 17-18. The left foot siderail assemblies 16, 216, 316, 416, and 516 are omitted from the hospital bed 610 and replaced with the left foot siderail 616. Left foot siderail 616 includes a handle 614 and a barrier panel 642. The handle 614, like the handle 14, is coupled the barrier panel 642 to move about the handle-pivot axis 74 between a storage position shown in FIG. 17 and an egress position shown in FIG. 18.

The barrier panel 642 includes a first portion 651, a second portion 652, and a third portion 653. The first portion 651 is also called a bottom portion 651, the second portion 652 is also called a medial portion 652, and the third portion 653 is also called a top portion 653. The top portion 653 is appended to the medial portion 652 to extend upwardly away from the medial portion 652. The barrier panel 642 also includes an outward side 648 that faces away from the mattress 22, an oppositely facing inward side 650 that faces toward the mattress 22, a foot edge 602 that faces toward the foot end 26 of the hospital bed 610, and a head edge 604 that faces toward the head end 602.

The handle 614 is coupled to the top portion 653 to move about the handle-pivot axis 74 in the counter-clockwise direction 78 from the storage position of FIG. 17 to the egress position of FIG. 18. The handle 614 includes a handle mount 688, a forward grip 690, and a lateral grip 696. The handle mount 688 interconnects the forward grip 690 and the lateral grip 696 to the barrier panel 642. The handle mount 688 also defines the handle-pivot axis 74 about which the handle 614 moves between the storage position and egress position.

When the handle 614 is in the storage position, the handle 614 extends downwardly from the top portion 653 of the barrier panel 642. As shown in FIG. 17, the handle 614 is coupled to a middle portion 612 of the top portion 653 of the barrier panel 642. The middle portion 612 is positioned about midway between the foot edge 602 and the head edge 604. The handle 614 cantilevers away from the middle portion 612 toward the foot edge 602. The handle 614, when in the storage position, cooperates with the barrier panel 642 to define a first barrier width 681 and a first barrier height 691.

The handle 614 when in the egress position of FIG. 18 supports a portion of a patient's weight during a patient's egress from the hospital bed 610 after the hospital bed 610 has moved to the chair-egress position. The handle 614 cooperates with the barrier panel 642 to define a second barrier width 682 and a second barrier height 692 as shown in FIG. 18. The second barrier width 682 is greater than the first barrier width 681 as a result of the handle 614 extending away from the inward side 650 of the barrier panel 642 toward the mattress 22. The second barrier height 692 is about the same as the first barrier height 691 because the top portion 653 is fixed in position relative to the medial portion 652.

The handle 614 cooperates with the medial portion 652 of the barrier panel 642 to define a pair of apertures 606, 608. As shown in FIG. 17, the first aperture 606 is formed by the handle mount 688, the forward grip 690, and the lateral grip 696. The second aperture 608 is formed when the handle 614 is in the storage position by the handle mount 688, a top side 611 of the medial portion 652, and a foot side 618 of the middle portion 612 included in the top portion 653. When the handle 614 moves to the egress position, the second aperture 608 is transformed into a U-shaped slot 620 that opens toward the foot end 26 of the hospital bed 610.

The illustrative hospital beds 10, 210, 310, 410, 510, and 610 are a so-called chair bed, in that it is movable between a bed position, as shown in FIG. 1, and a chair-egress position as shown in FIG. 2. However the teachings of this disclosure are applicable to all types of hospital beds, including those that are incapable of achieving a chair-egress position. Some hospital beds are only able to move into a chair-like position, sometimes referred to by those in the art as a "cardiac chair position," and this disclosure is equally applicable to those types of beds. Furthermore, the teachings of this disclosure are applicable to other types of patient support apparatuses such as stretchers, motorized chairs, operating room (OR) tables, specialty surgical tables such as orthopedic surgery tables, examination tables, and the like.

Although certain illustrative embodiments have been described in detail above, variations and modifications exist within the scope and spirit of this disclosure as described and as defined in the following claims.

The invention claimed is:

1. A siderail assembly for a patient support apparatus, the siderail assembly comprising:

a barrier adapted to mount to a frame of the patient support apparatus, the barrier configured to pivot relative to the patient support apparatus about a generally horizontal axis between a raised position and a lowered position while the barrier remains in a substantially vertical orientation, the barrier including an outward side adapted to face away from the patient support apparatus and an inward side adapted to face opposite the outward side, a handle coupled to the barrier to move relative to the barrier between a storage position in which the handle is arranged to lie in a generally vertical plane with the barrier and an egress position in which the handle is arranged to extend inwardly from the inward side of the barrier and lie in a generally horizontal plane, wherein the outward side of the barrier is formed to include a recess configured to receive and mate with a portion of the handle when the handle is in the storage position, and a handle lock coupled to the barrier to move therewith, the handle lock movable between a locked position in which the handle is locked in place in a position between the storage position and the egress position, and a freed position in which the handle is free to move relative to the barrier, wherein the handle pivots about a pivot axis that is spaced-apart from and generally parallel to the generally horizontal axis, wherein the handle includes a grip, the grip sized to receive a patient's hand and support a patient's weight during egress from the patient support apparatus.

2. The siderail assembly of claim 1, wherein the handle includes a handle mount coupled to the barrier to move about the pivot axis relative to the barrier, a forward grip coupled to the handle mount to move therewith, and a lateral grip coupled to both the forward grip and the handle mount to move therewith.

3. The siderail assembly of claim 2, wherein the handle mount includes a first pivot joint, a second pivot joint, and a bar positioned between and interconnecting the first and second pivot joints, the first pivot joint couples the bar to the barrier and the second pivot joint couples the bar to the barrier.

4. The siderail assembly of claim 2, wherein the handle mount includes a pivot joint and a bar, wherein the pivot joint lies between and interconnects the bar to the barrier for movement relative to the barrier, the forward grip and the lateral grip are coupled to the bar to move therewith, and the bar cantilevers away from the pivot joint toward a foot end of the patient support apparatus.

5. The siderail assembly of claim 1, wherein the handle lock includes a plunger coupled to the barrier to move relative to the barrier, a receiver formed in the handle and configured to mate with the plunger when the handle lock is in the locked position, and a bias spring coupled to the plunger to provide a bias force to the plunger to urge the plunger to mate with the receiver.

6. The siderail assembly of claim 5, wherein the handle lock further includes an actuator button coupled the barrier panel to move back and forth in a lateral direction relative to the barrier panel and is configured to apply an actuation force to the plunger to overcome the bias force and move the plunger from the locked position to the freed position.

7. The siderail assembly of claim 1, wherein the handle is coupled to the barrier to move about the pivot axis relative to the barrier between the storage position, a barrier-extension position in which the handle extends upwardly away from the barrier, a side-use position in which the handle extends away from the outward side of the barrier, and the egress position, and the handle lock is operable to lock the handle in one of the storage position, the barrier-extension position, the side-use position, or the egress position.

8. A siderail assembly for a patient support apparatus, the siderail assembly comprising:

a barrier adapted to be mounted to the patient support apparatus such that the barrier is movable about a generally horizontal axis between a raised position and a lowered position while the barrier remains in a substantially vertical orientation, the barrier including a foot edge, a spaced-apart head edge, an outward side and an oppositely facing inward side, the outward side formed to include a recess, a handle coupled to the barrier to rotate about a pivot axis relative to the barrier from a storage position to an egress position, wherein the handle when in the storage position lies in a substantially vertical plane, the vertical plane extending between the head and foot edges of the barrier, and the handle cooperating with the barrier to define a first barrier width, and the handle when in the egress position lies in a substantially horizontal plane, the handle cooperating with the barrier to define a second barrier width, the second barrier width being greater than the first barrier width, the handle configured to mate with the recess when the handle is in the storage position, and a handle lock coupled to the barrier to move therewith, the handle lock movable between a locked position in which the handle is locked in place in a position between the storage position and the egress position, and a freed position in which the handle is free to move relative to the barrier, wherein the pivot axis is spaced-apart from and generally parallel to the generally horizontal axis, wherein the handle includes a grip, the grip sized to receive a patient's hand and support a patient's weight during egress from the patient support apparatus.

9. The siderail assembly of claim 8, wherein the barrier includes a first portion coupled to a linkage and arranged to extend between the foot and head edges, and a second portion appended to the first portion and arranged to extend between the foot and head edges and extend upwardly away from the first portion, and a third portion appended to the second portion to locate the second portion between the first and third portions and the third portion is arranged to extend upwardly away from the first and second portions.

10. The siderail assembly of claim 9, wherein the handle is coupled to the third portion and the pivot axis is spaced-apart above the second portion of the barrier.

11. The siderail assembly of claim 10, wherein the third portion of the barrier is formed to include an aperture adapted to receive a hand of a patient therein.

12. The siderail assembly of claim 9, wherein the handle is coupled to the third portion of the barrier and the handle extends away from the foot edge of the barrier toward a middle point of the barrier and the middle point of the barrier is spaced-apart from and between the foot and head edges of the barrier.

13. The siderail assembly of claim 9, wherein the handle is coupled to the second portion of the barrier to locate the second portion between the handle and the first portion and the handle is arranged to extend upwardly away from the second portion when the handle is in the storage position.

14. The siderail assembly of claim 8, wherein the handle extends from the foot edge of the barrier toward a middle point of the barrier and the middle point of the barrier is spaced-apart from and positioned between the foot and head edges of the barrier.

15. A siderail assembly for a patient support apparatus: the siderail assembly comprising, a barrier adapted to be mounted to the patient support apparatus to move between a raised position and a lowered position while the barrier remains in a substantially vertical orientation, the barrier including an outward side and an oppositely facing inward side, and a handle coupled to the foot end of the barrier to pivot about a pivot axis relative to the barrier between a storage position in which the handle lies in generally coplanar relation with the barrier and cooperates with the barrier to establish a first barrier height and a first barrier width, a barrier-extension position in which the handle extends upwardly away from the barrier and cooperates with the barrier to establish a second barrier height which is greater than the first barrier height, a side-use position in which the handle extends away from the outward side of the barrier and cooperates with the barrier to define a third barrier height and a second barrier width which is greater than the first barrier width, and an egress position in which the handle extends away from the inward side of the barrier and cooperates with the barrier to establish a fourth barrier height which is about equal to the third barrier height and less than the second barrier height and a third barrier width which is about equal to the second barrier width and greater than the first barrier width, and a handle lock coupled to the barrier to move therewith, the handle lock movable between a locked position in which the handle is locked in place in each of the storage position, the barrier extension position, the side-use position, and the egress position, and a freed position in which the handle is free to move relative to the barrier.

16. The siderail assembly of claim 15, wherein the siderail assembly includes a user interface coupled to the handle to move therewith, the user interface is adapted to send a first input to a bed controller to control movement of the patient support apparatus in response to the first input.

17. The siderail assembly of claim 16, wherein the siderail assembly further comprises a sensor configured to sense a position of the handle relative to the barrier and the sensor is adapted to send a second input to a bed controller to control movement of the patient support apparatus in response to the second input.

* * * * *